US006695511B2

(12) United States Patent
Lundak

(10) Patent No.: US 6,695,511 B2
(45) Date of Patent: Feb. 24, 2004

(54) SOAPSTONE HOLDER

(75) Inventor: Timothy W. Lundak, Glen Carbon, IL (US)

(73) Assignee: St. Louis Crayon & Soapstone, Inc., St. Louis, MO (US)

( * ) Notice: Subject to any disclaimer, the term of this patent is extended or adjusted under 35 U.S.C. 154(b) by 0 days.

(21) Appl. No.: 10/172,918

(22) Filed: Jun. 17, 2002

(65) Prior Publication Data

US 2003/0231920 A1 Dec. 18, 2003

(51) Int. Cl.[7] ..... A45D 40/20; B43K 21/22

(52) U.S. Cl. ..... 401/88; 401/92; 401/55; 401/117

(58) Field of Search ..... 401/88, 48, 89, 401/90, 92, 95, 55, 56, 57, 91, 109, 112, 117, 111, 93, 94

(56) References Cited

U.S. PATENT DOCUMENTS

| | | | | | |
|---|---|---|---|---|---|
| 1,931,138 | A | * | 10/1933 | Staff | 401/88 |
| 2,043,250 | A | | 6/1936 | Kasdan et al. | |
| 2,056,384 | A | * | 10/1936 | Brandon | 401/92 |
| 2,365,802 | A | | 12/1944 | Browse | |
| 2,823,644 | A | * | 2/1958 | van den Bussche et al. | 401/94 |
| 2,951,584 | A | * | 9/1960 | Bauer | 401/55 |
| 3,756,727 | A | | 9/1973 | Gallagher | |
| 4,500,221 | A | | 2/1985 | Emerson | |
| 4,595,136 | A | | 6/1986 | Cooper | |
| D303,992 | S | | 10/1989 | Grotsch | |
| 5,577,850 | A | | 11/1996 | Mishima | |
| 5,679,401 | A | | 10/1997 | Bawden | |
| 5,865,550 | A | * | 2/1999 | Bouix | 401/88 |
| 6,276,854 | B1 | * | 8/2001 | Mullins | 401/88 |

FOREIGN PATENT DOCUMENTS

| | | |
|---|---|---|
| EP | 0745810 | 5/1996 |

* cited by examiner

*Primary Examiner*—David J. Walczak
(74) *Attorney, Agent, or Firm*—Polster, Lieder, Woodruff & Lucchesi, LC

(57) ABSTRACT

A holder for marking material includes a housing and a collet which moves axially in the housing. The housing has a first side wall and a second side wall opposite the first side wall. Cavities having sloping surfaces are formed in the housing first side. The collet includes an arm having wedges formed on its outer surface and positioned to be received in the housing cavities. The collet is movable between an extended position in which the sloped surface of the housing cavities engage the collet arm wedges to urge the collet arm transversely towards the housing second wall to frictionally grip the marking material in the holder and a second position in which the wedge is received in the housing cavity such that no transverse force is applied to the collet arm, and the marking material can move freely relative to the holder.

10 Claims, 3 Drawing Sheets

SOAPSTONE HOLDER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to holders for soapstone markers, and, in particular, to a soapstone holder which allows for easy advancement a stick of soapstone as the soapstone stick wears down.

Soapstone is often used as a marker to mark various materials. Soapstone marking sticks are commonly provided in lengths of about 5" and have cross-sectional dimensions of about 0.2"×0.5". Soapstone sticks are fragile or brittle, and, are easily broken during use if not held in a protective holder. Such broken sticks are often too small for further use, and hence are discarded. Various holders have been designed to protect soapstone sticks to prevent breakage of the sticks during use. However, such prior holders have drawbacks—they are expensive to produce, difficult to use, and do not allow for easy advancement of the soapstone stick as it wears down.

BRIEF SUMMARY OF THE INVENTION

Briefly stated, a holder for marking material is provided which is simple to assemble and operate, and which allows for the gravity feed of the marking material to advance the marking material in the holder. The holder is a two piece assembly which includes a housing and a collet which moves axially in the housing. The housing is hollow and open at its opposite ends. It has a first side wall and a second side wall opposite the first side wall. At least one, and preferably two or more cavities are formed in the housing first side. The cavities each have a sloped outer surface, and at least one of the cavities includes a shoulder which extends from the cavity sloped surface to the inner surface of the first wall. The second side wall has an inner surface shaped to correspond generally to the shape of the marking material.

The collet includes a body and an arm extending from the body. The collet is sized such that the at least a portion of the collet body extends from the top of the housing, and the collet arm extends from the base of the collet body substantially to the opposite end of the housing. The collet arm has an inner surface and an outer surface. The arm inner surface is shaped to correspond generally to the shape of the marking material. The arm has at least one wedge, and preferably two or more wedges, formed on its outer surface and positioned to be received in said housing cavities. The collet is movable between an extended position in which the sloped surface of said housing cavity engages the collet arm wedge to urge the collet arm transversely towards the housing second wall to frictionally grip the marking material in the holder and a second position in which the wedge is received in the housing cavity such that no transverse force is applied to the collet arm, and the marking material can move freely relative to the holder.

The holder also includes a biasing element to bias the collet to the extended position. The biasing element is preferably a spring which has a generally S-shape. The spring has a first end in contact with a base of the collet body and a second end which engages the housing. The housing includes an opening, and, the spring includes a finger at its second end. The spring finger is received in the housing opening. Preferably, the spring is integrally formed with the collet.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
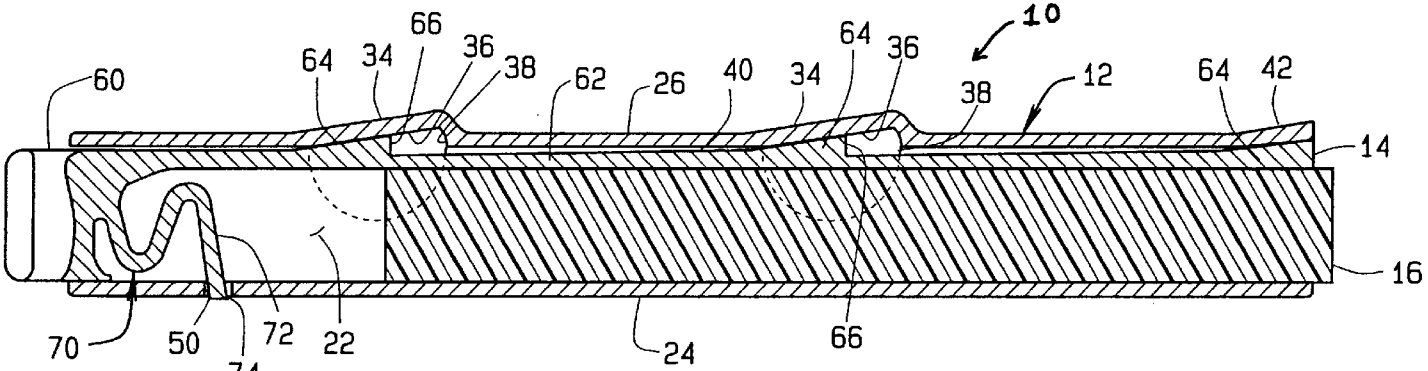
FIG. 1 is a cross-sectional view of an illustrative embodiment of a soapstone holder of the present invention, showing the holder gripping a length of soapstone.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
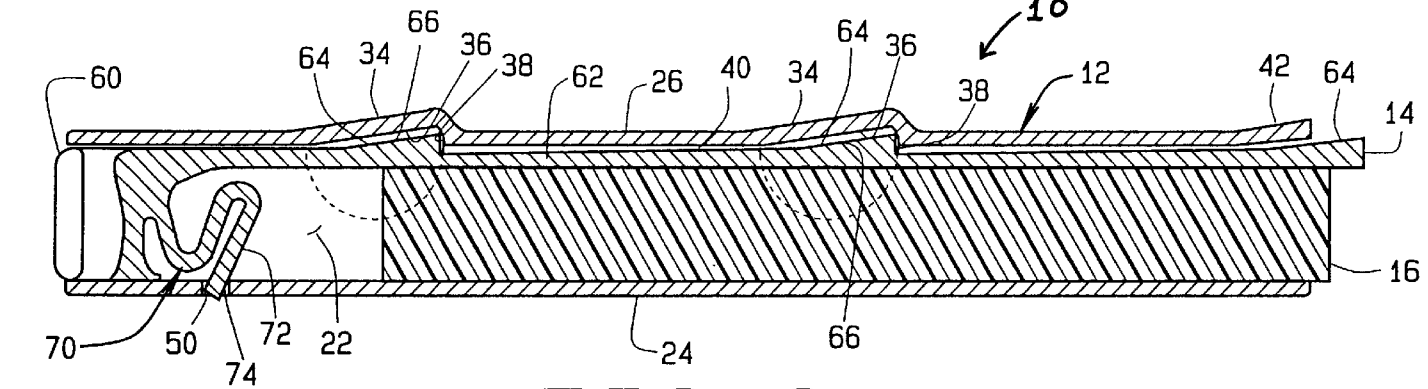
FIG. 2 is a cross-sectional view similar to FIG. 1, but showing the holder being activated to allow for advancement of the soapstone stick.
Figure 3:
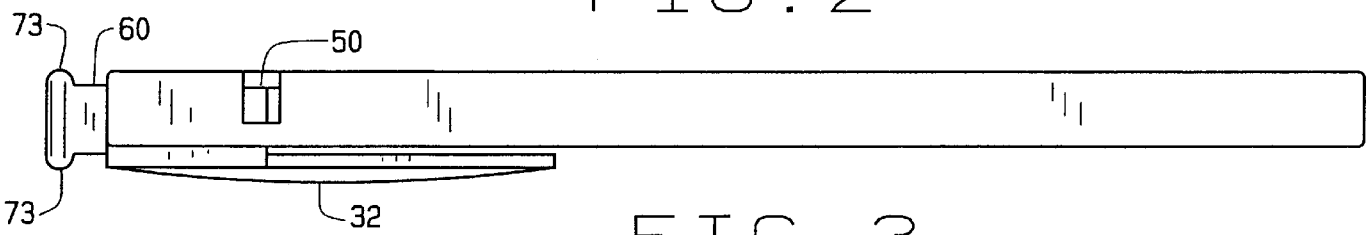
FIG. 3 is a side elevational view of the soapstone holder.
Figure 4:
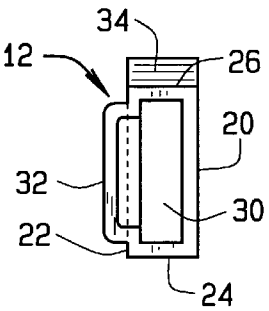
FIG. 4 is an end elevational view a housing for the soapstone holder.
Figure 5:
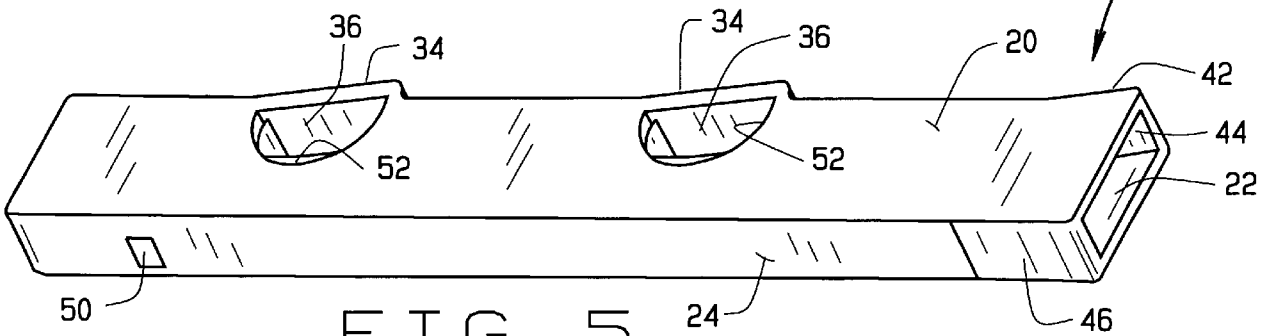
FIG. 5 is a perspective view of the housing.
Figure 6:
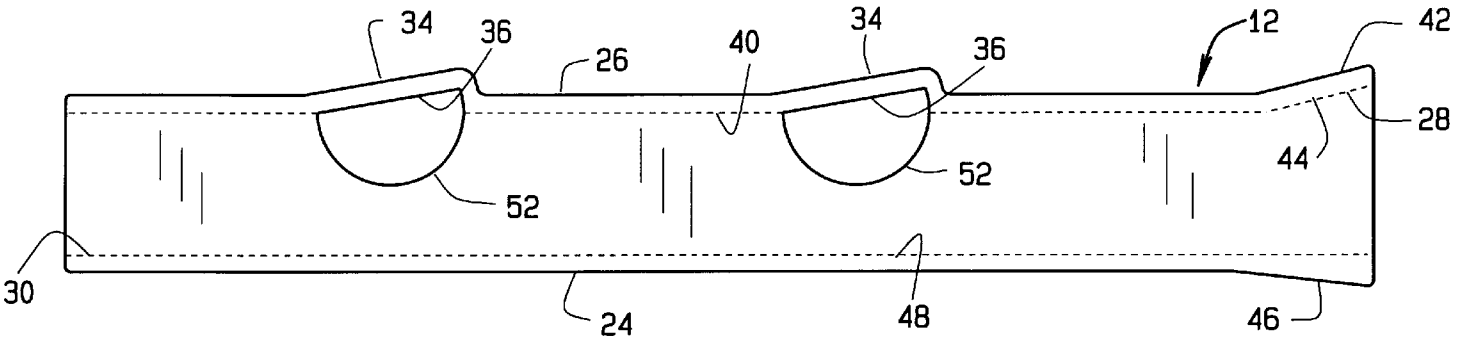
FIG. 6 is a top plan view of the housing.

A soapstone or marking material holder 10 is shown generally in FIGS. 1 and 2. The soapstone holder 10 includes a housing 12 which is generally in the shape of a hollow rectangular tube. The housing 12 receives a collet 14. In FIG. 1, the holder 10 is shown with the collet 14 in a retracted position, in which the collet clamps a soapstone stick 16 in place in the holder to prevent advancement of the soapstone. In FIG. 2, the collet is shown in an extended position in which the collet does not grip or clamp the soapstone stick, and in which the soapstone stick can be advanced under the force of gravity. The holder is sized to receive a standard stick of soapstone. Such soapstone sticks are typically 5" long; and are rectangular in end elevation with dimensions of 3/16"×½". Thus, the holder has an overall length of about 6", approximately the length of a typical pen or pencil, and is sized, for example, to fit within a shirt pocket. It will be appreciated that the holder can also be sized to accommodate soapstone sticks that have cross-sectional dimensions of 1/16"×½" or 3/32"×½". Also, it can be sized and configured to receive soapstone sticks that are ¼" in diameter. Although described for use with soapstone sticks of the noted dimensions (which are the more common dimensions for soapstone sticks), the soapstone holder of the current invention can be configured to accept soapstone sticks of any desirable cross-sectional configuration.

The housing 12 includes a top wall 20, a bottom wall 22, and side walls 24 and 26. The housing 12 has opened ends 28 and 30. The holder includes a clip 32 on its bottom wall 22 to allow the holder to be clipped, for example, in a shirt pocket. The side wall 26 includes two sloped sections 34. The sections 34 each include a sloped inner surface 36, and end in a shoulder 38 which is substantially perpendicular to the inner surface 40 of the side wall 26. A third sloped section 42 is formed at the end 28 of the holder 12 and includes a sloped inner surface 44. As can be appreciated, the two sections 34 and the third section 42 define cavities in the inner surface 40 of the side wall 26 which have the sloped surfaces 36 and 44. The slope of the three sloped inner surfaces is the same. The sloped surfaces 36 are of the same length. The sloped surface 44, however, is shorter than the surfaces 36. The side wall 24 also includes a sloped portion 46 opposite the sloped portion 42. However, the inner surface 48 of the wall 24 is substantially straight. Hence, the sloped portion 46 forms an area of the side wall 24 of increased width. The side wall 24 also includes an opening 50 spaced from the top end 30.

A pair of openings 52 are formed in the top wall 20. The openings extend from the side wall 26 and are aligned with the sloped projections 34. The openings 52 are shown to be generally semi-circular in shape and to have a length, at the wall 26, approximately equal to the length of the sloped surfaces 36. The openings are provided to enable a user to see where the top of the soapstone stick is in the holder, so that the user can gauge how much of the soapstone stick remains. The openings 52 can be omitted; their shape can be changed, or they can be replaced with an elongate slot which extends along the top wall to allow for viewing of a greater length of the soapstone.

Figure 7:
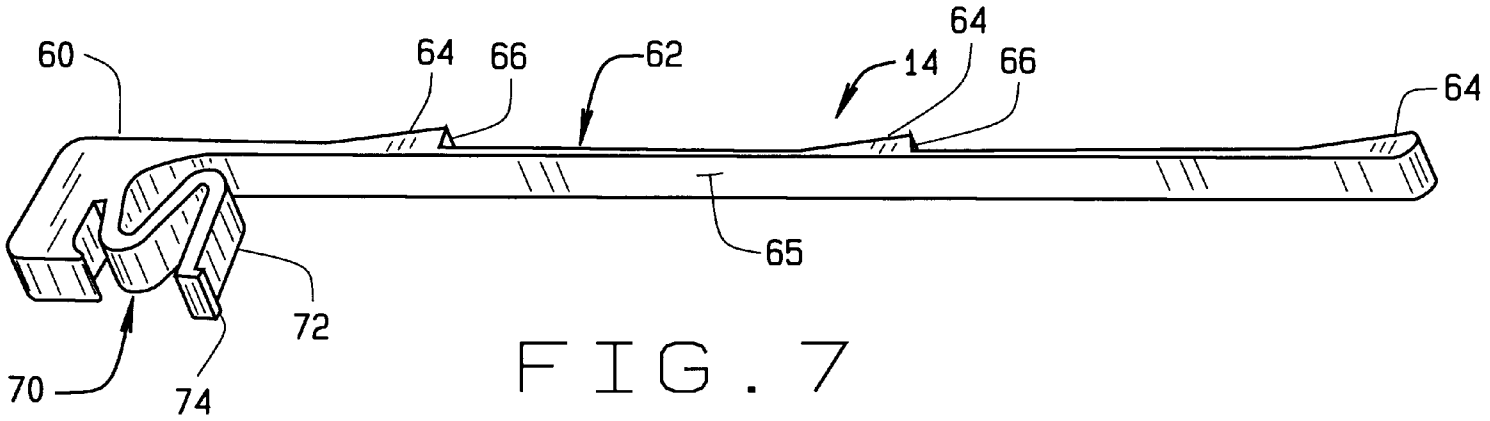
FIG. 7 is a perspective view of a collet for the holder.

The collet 14 (FIGS. 7 and 8) includes a body 60 which is sized to be received within the hollow housing 12. An arm 62 extends from the base of the body 60 at one side of the body. The arm is generally rectangular in cross-section, and is sized to be received with in the housing 12. Preferably, the arm 62 has a height slightly less than the height of the housing between the inner surfaces of the housing top and bottom walls 20 and 22. The inner surface 65 of the arm 62 is substantial smooth. Preferably, the arm inner surface corresponds in shape to the shape of the soapstone stick. In the embodiment shown, the surface 65 is generally planar, and is designed for use with a rectangular soapstone stick.

The arm 62 has three spaced apart wedges 64 formed on the outer surface 63 of the arm. The wedges 64 have bases 66, which are preferable generally perpendicular to the arm outer surface 63. The last wedge 64 is at the end of the arm 62. Preferably, the end of the arm is curved, as seen in the figures. Hence, the base of this last wedge is not straight or planar, as is the base of the other two wedges. The wedges are spaced apart to be received in the housing sections 34 and 42, and the slope of the wedges corresponds substantially to the slope of the section inner surfaces 36 and 44.

Figure 8:
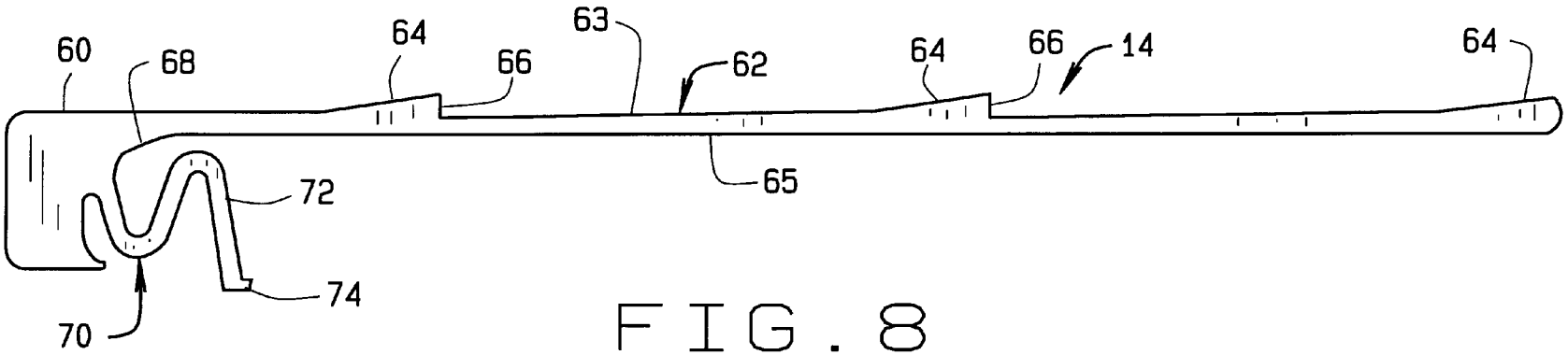
FIG. 8 is a top plan view of the collet.

The base of the body 60 is shown to form a curved surface 68. A generally S-shaped spring member 70 extends form the curved surface 68. The end of the spring 70 is defined by a leg 72 which ends in a small finger or hook 74. When relaxed, as seen in FIG. 8, the spring leg 72 extends beyond the side wall of the collet body 60 a distance approximately equal to the width of the housing side wall 24. Preferably, the spring member is integrally formed with the collet. However, the spring member 70 can be separate from the collet if desired. This would enable the use of different types of spring elements. The top of the collet body 60 can be provided with flanges 73 to increase the surface area of the collet body, to make the collet body more comfortable to press against.

The collet, as will be described below, is used to advance the soapstone in the holder 10. Thus, the collet has an overall length that is greater than the length of the housing 12. For example, as noted above, the holder has an overall length of about 6". The housing can have an overall length of about 5.7", and the collet can have an overall length of about 5.85" to about 5.9" such that the collet body 60 extends about 0.15" to about 0.2" past the end 30 of the housing 12.

To assemble the holder 10, the collet 14 is inserted into the housing 12, such that the collet arm 62 extends along the housing wall 26 so that the collet wedges 64 will be received in the housing sections 34 and 42. The collet spring 70 is sized and shaped, and the housing wall opening 50 is positioned, such that the finger 74 at the end of the spring leg 72 will be received in the opening 50. The spring 70 thus biases the collet to its extended position, as seen in FIG. 1.

The collet has a width such that the distance between the collet arm inner surface 65 and the inner surface 48 of the housing wall 24 is slightly greater than the width of a soapstone, so that the soapstone can freely slide in the holder. When the holder is in the extended position, as seen in FIG. 1, the spring 70 biases the collet upwardly to its extended position. In this position, the collet wedges 64 engage the inner surfaces 36 and 44 of the housing sections 34 and 42. This engagement of the collet wedges with the section inner surfaces urges the collet arm toward the housing wall 24, and hence, the soapstone will be positively engaged and clamped (or gripped) between the collet arm inner surface and the inner surface 48 of the housing wall 24. Thus, the soapstone will be frictionally held in place in the housing 12 by the collet 14.

To advance the soapstone, the body 60 of the collet is depressed to move the collet arm 62 axially along the housing side wall 26. The extension of the collet body 60 beyond the housing end 30 is sufficient to push the collet 14 axially until the collet wedge bases 66 engage the shoulders 38 of the housing sections 34. In this position, the collet wedges will be fully received in the sloped housing sections (as seen in FIG. 2); there will be no positive engagement between the sloped surfaces 36 of the housing sections 34; and the collet arm will not be urged transversely across the housing. Thus, the grip of the collet on the soapstone will be released, and the soapstone can slide within the housing under the force of gravity. When the soapstone has advanced (either under the force of gravity, or by being pulled by the user), the collet body is released; the spring 70 will return the collet to its extended position (FIG. 1); and the collet will again grip the soapstone in the housing.

As the soapstone wears down, the soapstone will be in contact with less and less of the collet arm (although the full length of soapstone within the housing will be in contact with the collet arm). The wedge and the housing section at the end of the collet and housing, respectively, will thus enhance the holding power of the collet on the soapstone, especially when the soapstone is short. Additionally, the thickening of the housing wall at 46 opposite the housing section 42 reinforces the end of the housing. Further, the use of three spaced apart sections and wedges causes the collet to be moved transversely across the housing chamber at multiple locations. This will help enhance the gripping of the soapstone by the collet, even when, for example, the end of the soapstone is between the end projection and the middle projection. Hence, although the holder could be made, for example, with only the housing section 42 at the end of the housing and the wedge at the end of the collet arm, the use of multiple wedges and sections enhances the gripping power of the collet.

As can be appreciated, the holder relies on a spring biased or reinforced wedging action to grip the soapstone (or other marking material) by urging the collet arm transversely across the holder chamber under the interaction of the collet wedges with the sloped inner surfaces of the housing. To provide the greatest frictional grip of the collet arm on the soapstone, the inner surface 65 of the collet arm 62 and the inner surface 48 of the housing wall opposite the collet arm are shaped to conform generally to the shape of the soapstone. Additionally, the collet arm is sized to have a height approximately the height of the soapstone. Thus, although chamber which is formed by the housing and the collet in which the soapstone is received is generally rectangular in cross-section, the holder could work equally well with, for example, a cylindrical marking material, by giving the arm and the housing opposing wall curved inner surfaces.

As various changes could be made in the above constructions without departing from the scope of the invention, it is intended that all matter contained in the above description or shown in the accompanying drawings shall be interpreted as illustrative and not in a limiting sense. For example, although three wedges and projections are shown on the collet and housing, respectively, more or fewer projections could be provided. Additionally, the length and size of the projections and wedges could be changed depending on the size of the marking material being used. The spring 70 is shown to be integral with the collet body. However, the spring 70 could be an independent part. The spring 70 could be replaced with other spring elements. For example, springs could be placed in the housing sections 34 to extend between the section shoulders 38 and the collet wedge base 66. Alternatively, the housing and collet body could be configured to receive a leaf spring, or a spring washer, which would bias the collet to its extended position of FIG. 1. The end section 42 and its corresponding collet wedge are formed at the end of the housing and the collet arm respectively. The end projection 42 could be spaced slightly from the end of the housing, so that the section 42 could include a shoulder, as with the sections 36. The wedge at the end of the collet arm would then be moved accordingly. The housing 12 could be formed to have a width such that the outer surfaces of the housing were smooth. In this case, there would be not projecting sections from the housing side wall 26, and the sloped surfaces 36 and 44 would be the sloped surfaces of cavities formed in the side wall. These examples are merely illustrative.

What is claimed is:

1. A holder for marking material; the holder comprising:

a hollow housing; the housing having a first side wall with at least one sloped section on said side wall defining a housing projection, and a second side wall opposite said first side wall; said second side wall having an inner surface; said sloped section including a sloped inner surface; and a collet; said collet having a body, an arm extending from said body, and a biasing element; said collet including a wedge on an outer surface of said arm and positioned to cooperate with said inner surface of said housing sloped section; said body extending from a top end of said housing; and said biasing element extending between said collet and said housing; said collet being movable between an extended position in which said sloped surface of said housing section engages said collet arm wedge to urge said collet arm transversely towards said housing second wall to frictionally grip said marking material in said holder and a second position in which said wedge is received in said housing projection such that no transverse force is applied to said collet arm, and said marking material can move freely relative to said holder; said biasing element biasing said collet to said extended position.

2. The holder of claim 1 wherein said biasing element is a spring, said spring having a first end in contact with a base of said collet body and a second end which engages said housing.

3. The holder of claim 2 wherein said spring includes a finger at said second end; said housing including an opening in a wall thereof, said spring finger being received in said housing opening.

4. The holder of claim 2 wherein said spring is integral with said collet; said spring being generally S-shaped.

5. The holder of claim 1 wherein said sloped housing section is formed near a bottom end of said housing, and said collet wedge being formed near an end of said collet arm.

6. The holder of claim 5 wherein said sloped housing section is a first sloped section and said collet wedge is a first collet wedge; said housing including at least a second sloped section on said first wall spaced axially from said first sloped section and at least a second wedge on said collet arm outer surface spaced axially from said collet first wedge.

7. The holder of claim 1 wherein said collet arm has an inner surface, the collet arm inner surface and said housing second wall inner surface are shaped to correspond to the shape of said marking material.

8. A holder for marking material; the holder comprising:

a hollow housing having a first side wall and a second side wall opposite the first side wall; at least one cavity formed in an inner surface of said first side wall; said cavity having a sloped surface; said cavity projecting outwardly to define a housing projection, said second side wall having an inner surface shaped to correspond generally to the shape of the marking material;

a collet having a body and an arm extending from said body; said collet arm having an inner surface and an outer surface; said arm inner surface being shaped to correspond generally to the shape of the marking material; said arm outer surface having a wedge positioned to be received in said housing cavity; said collet being movable between an extended position in which said sloped surface of said housing section engages said collet arm wedge to urge said collet arm transversely towards said housing second wall to frictionally grip said marking material in said holder and a second position in which said wedge is received in said housing projection such that no transverse force is applied to said collet arm, and said marking material can move freely relative to said holder; and, a spring positioned to bias said collet to said extended position.

9. The holder of claim 8 wherein said biasing element is a spring, said spring having a first end in contact with a base of said collet body and a second end which engages said housing.

10. The holder of claim 8 wherein said cavity section is a first cavity and said collet wedge is a first collet wedge; said housing including at least a second cavity on said first wall spaced axially from said first cavity; said second cavity including a sloped surface and a shoulder extending from said sloped surface to said first wall inner surface; said collet including at least a second wedge on said collet arm outer surface spaced axially from said collet first wedge to be received in said housing second cavity; said second wedge having a base; said cavity shoulder and said second wedge base engaging each other when said collet is moved to said second position to limit axial movement of said collet relative to said housing.

* * * * *